US005273594A

United States Patent [19]

Cassada, III

[11] Patent Number: 5,273,594

[45] Date of Patent: Dec. 28, 1993

[54] DELAYING FINAL STRETCHING FOR IMPROVED ALUMINUM ALLOY PLATE PROPERTIES

[75] Inventor: William A. Cassada, III, Richmond, Va.

[73] Assignee: Reynolds Metals Company, Richmond, Va.

[21] Appl. No.: 816,682

[22] Filed: Jan. 2, 1992

[51] Int. Cl.[5] ..... C22F 1/04

[52] U.S. Cl. ..... 148/696; 148/550; 148/697; 148/698; 148/699; 148/700; 148/701; 148/702; 148/689; 148/690; 148/415; 148/438; 148/439

[58] Field of Search ..... 148/550, 696, 697, 698, 148/699, 700, 701, 702, 689, 690, 415, 438, 439

[56] References Cited

U.S. PATENT DOCUMENTS 4,294,625 10/1981 Hyatt et al. ..... 148/550

4,808,248 2/1989 Ozelton et al. ..... 148/693

*Primary Examiner*—R. Dean

*Assistant Examiner*—Robert R. Koehler

*Attorney, Agent, or Firm*—Alan M. Biddison

[57] ABSTRACT

The present invention provides a method for improving aluminum alloy plate product properties by delaying final stretching of the plate product. During processing of the product, a time interval or intentional delay is provided between the final cold rolling step and the final stretching step. By delaying the final stretching procedure, an aluminum alloy plate product is provided with an improved fracture toughness without significant decrease in strength values. The method of intentionally delaying final stretching is particularly adapted for 2000 series aluminum alloys.

14 Claims, 3 Drawing Sheets

DELAYING FINAL STRETCHING FOR IMPROVED ALUMINUM ALLOY PLATE PROPERTIES

FIELD OF THE INVENTION

The present invention is directed to aluminum alloys and more particularly 2000 series aluminum alloys used for plate production. Improved fracture toughness is achieved for these types of alloys without significant strength reduction by delaying stretching of the aluminum alloy plates following cold rolling.

BACKGROUND ART

In the aircraft industry, it has been generally recognized that one way of improving fuel efficiency of aircraft is to reduce the structural weight of airplanes. In reducing the structural weight of airplanes, aluminum alloys have been developed which have high strength to weight ratios along with high levels of fracture toughness, fatigue resistance and corrosion resistance.

One family of aluminum alloys typically used in commercial aircraft application is the Aluminum Association 2000 series of registered alloys.

Further improvements have been recognized in the prior art concerning the 2000 series aluminum alloys relating to improved fracture toughness and fatigue resistance by careful control of the processing steps during aluminum alloy plate manufacture. U.S. Pat. No. 4,294,625 to Hyatt et al. describes aluminum alloys, more particularly 2000 series aluminum alloys characterized by high strength, very high fatigue resistance and very high fracture toughness. The patent to Hyatt et al. discloses a method for producing the plate product from an aluminum alloy having high toughness comprising casting the alloy into a body and hot working the body to form a plate product. The plate product is then solution heat treated such that the maximum amount of copper in the alloy is taken into solid solution. Following the solution heat treating step, the plate product is quenched, pre-aged at room temperature and cold rolled to reduce the thickness of the product and to increase its strength. Following cold rolling, the product is stretched to relieve residual stresses in the product. The stretching step is performed to flatten and strengthen the product and to remove residual quenching and/or rolling stresses from the product. Hyatt et al. discloses a maximum of 1% stretching for plate products since stretching beyond 2–3% causes increased incidence of breakage during the stretching process. Also, it is difficult to maintain desired levels of fracture toughness if the product is stretched more than 1%. Extrusions are stretched 1–3% as is normally required for all commercial alloys. Since extrusions are not cold rolled, they are in a relatively soft condition prior to stretching. As a result, extrusions generally are not susceptible to an increased incidence of breakage during stretching greater than 1%.

However, difficulties have been encountered in 2000 series aluminum alloys due to property losses such as decreased fracture toughness as a result of final plate stretching operations. In order to achieve desired strength levels, final stretching may be extended beyond the 1% value discussed in the Hyatt et al. patent to values up to 3.0%. The increased strength levels of the stretched plate, however, are accomplished at the sacrifice of fracture toughness. In fact, it may not be possible to obtain minimum fracture toughness levels at these increased strengths.

Accordingly, a need has developed to increase fracture toughness levels of these types of aluminum alloys while still maintaining satisfactory strength to weight ratios.

In response to this need, the present invention provides a method of improving aluminum alloy plate fracture toughness by delaying the final stretching operation following cold rolling.

The patent to Hyatt et al. does not teach controlling the time period between cold rolling and stretching. Moreover, Hyatt et al. does not recognize the improvements in fracture toughness as a result of delaying the stretching operation following cold rolling by a predetermined time period.

SUMMARY OF THE INVENTION

It is accordingly a first object of the present invention to provide a method including delaying the final stretching of an aluminum alloy plate product to provide improved plate properties such as fracture toughness.

It is a further object of the present invention to provide a method of improving fracture toughness properties of 2000 series aluminum alloys for plate production.

Another object of the present invention is to provide a method of improving fracture toughness properties of 2000 series aluminum alloys by providing a specified minimum time lapse between the cold rolling step and the final stretching procedure.

Other objects and advantages of the present invention will become apparent as the description proceeds.

In satisfaction of the preceding, there is provided by the present invention a method of making a 2000 series aluminum alloy plate product comprising the steps of:

(a) casting said aluminum alloy into an ingot;
(b) forming said ingot into a plate;
(c) solution heat treating said plate;
(d) quenching said plate;
(e) aging said plate;
(f) cold rolling said plate; and
(g) stretching said plate, said stretching step further comprising the step of providing a least a minimum interval of time between the cold rolling step and the stretching step such that the stretched aluminum alloy plate will exhibit improved fracture toughness while retaining acceptable levels of strength.

Also provided by the present invention is a plate product made by the method of making the 2000 series aluminum alloy plate product having improved fracture toughness.

BRIEF DESCRIPTION OF DRAWINGS

Reference is now made to the Drawings accompanying the application wherein.

DESCRIPTION OF THE PREFERRED EMBODIMENTS

Figure 1:
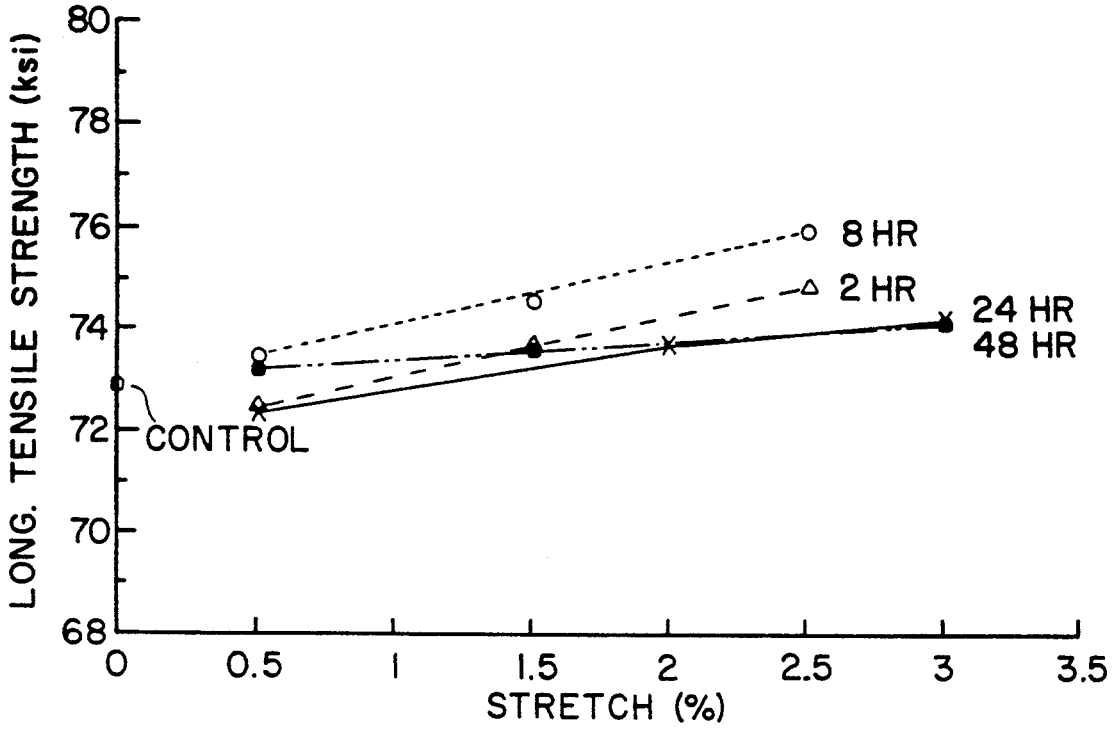
FIG. 1 shows a graph plotting tensile strength as a function of stretch percent for various time intervals following cold rolling.

The present invention is concerned with a method of making aluminum alloy plate, in particular 2000 series aluminum alloy plate, having improved fracture toughness. In the prior art, these types of alloys are ingot cast and formed into plates, solution heat treated, quenched, aged, cold rolled and finally stretched. The previously known final stretching procedures are designed to relieve residual stresses in the aluminum alloy plate product. Besides flattening the plate product, the final stretching procedure strengthens the product as a result of additional cold working due to the stretching, for example, a 1% level. However, the final stretching procedure, although providing benefits concerning flatness and strength, adversely affects to a degree the fracture toughness and fatigue resistance of the aluminum alloy plate. Additionally, the prior art commercial practice, which normally limits the stretch to the 1% level, might not achieve an adequate level of residual stress relief which makes the product more difficult to handle during subsequent fabrication processing, such as machining the plate product to form a wing skin. For example, wing skins produced from plate containing a random distribution of residual stresses tend to warp during machining creating the need for additional handling to control the warpage. A plate product produced with adequate residual stress relief is more easily processed into a final product form, saving the time and expense required by extra handling.

The present invention overcomes the disadvantages associated with the reduction in fracture toughness of prior art aluminum alloy plate products. As a result of providing at least a minimum time interval prior to the final stretching procedure, aluminum alloy plate products are produced having improved fracture toughness. In prior art processes, stretching an aluminum alloy plate product results in decreases on the order of 20% in fracture toughness when the final stretching procedure is performed without any intentional time delay following cold rolling. By providing a sufficient amount of time between the cold rolling step and the final stretching operation, the aluminum alloy plate product of the present invention exhibits less of a decrease in fracture toughness such that the end product has an overall improved fracture toughness than those aluminum alloy products subjected to prior art processes. Moreover, the method of the present invention provides an aluminum alloy plate product having not only improved fracture toughness but also acceptable levels of yield and tensile strengths.

Prior to the inventive step of providing a minimum time interval before stretching the aluminum alloy plate product, the aluminum alloy plate product may be made using conventional processing techniques that are well known in the art. For example, the aluminum alloy may be melted and cast into an ingot using conventional procedures such as continuous direct chill casting. After forming the ingot, the internal structure may be homogenized prior to hot working the ingot into a desired plate shape. Alternatively, the plate product may be made by other conventional techniques such as direct continuous casting to a plate shape or continuous casting followed by hot working.

The preferred alloys for the present invention include aluminum alloys selected from the 2000 series, such as Aluminum Association registered aluminum alloy 2324. Typically, this alloy is supplied in the T39 temper and is referred to as a 2324-T39 plate product. This product, according to the Aluminum Association's publication titled "TEMPERS for Aluminum and Aluminum Alloy Products", revised Aug. 1, 1989, has:

Standard 2024 solution treatment and quench followed by 11% nominal cold roll and 1% min stretcher stress relief.

The registered limits for the alloy composition, as of February 1991, include the following elements, in weight percentages: silicon −0.10 max, iron −0.12 max, copper −3.8–4.4, manganese −0.30–0.9, magnesium −1.2–1.8, chromium −0.10 max, zinc −0.25 max, titanium −0.15 max and the balance aluminum and incidental impurities (each −0.05 max, total −0.15 max).

Typical of these types of precipitation hardenable alloys, the aluminum alloy plate product of the present invention is solution treated after the hot working step. After solution treating, the plate product is quenched, pre-aged and cold rolled to a predetermined thickness. It should be understood that the processing of the 2000 series aluminum alloys for plate product is well known in the art. Accordingly, the specific process conditions related to the various processing steps are not described herein.

After the cold rolling step, the present invention provides for a delay of the subsequent stretching process for at least a predetermined minimum time period. Effects of the delay for at least a predetermined minimum time, as will be described hereinafter, may be explained in terms of the structure of the aluminum alloy plate product prior to stretching. It is believed that by providing a time delay prior to the stretching operation, the natural aging process of the aluminum alloy plate reaches metastable equilibrium. Modifications of the dislocation structure introduced by stretching, therefore, have less negative influence on the fracture toughness. Toughness is still decreased with the process provided by the present invention; however, it is diminished to a smaller extent than with previously used processes.

The following examples are presented to illustrate the invention but the invention is not to be considered to be limited thereto. In order to deconvolute the influence of the stretch variable on plate properties, the examples were conducted in such a manner that other important process variables were held constant. These variables include plate composition, grain structure, natural aging time prior to cold rolling and the amount of cold rolling. The examples quantitatively illustrate the influence of both the delay and the amount of final stretch on final plate properties.

The following experimental procedure was utilized in examining the effect of hold time between cold rolling and final stretching operations.

Samples of a single lot of a one inch gauge 2324-T39 plate were used in order to fix the sample composition and grain structure. The plate was produced using conventional processing techniques including ingot casting and hot rolling to the one inch gauge.

Three 8 inches wide × 18 inches longitudinal samples were batch solution heat treated for 1.5 hours at about 925½F. and water quenched to an ambient temperature of about 70½F. The samples were allowed to naturally age at room temperature for an interval of 16 hours between the quenching and cold rolling operations. The three pieces then were cold rolled 11 +/− 0.5%. The cold rolled samples were sawed longitudinally into 12−1 inch ×18 inches strips. The sawed strips were subsequently stretched at various times after cold rolling, ranging from 2–48 hours, and at various amounts of stretch, ranging from 0.5–3.0%.

Longitudinal tensile testing was performed using duplicate 0.350 inch diameter specimens for each experimental condition. Fracture resistance was determined by measuring the Charpy Impact Energy (CIE) on duplicate Charpy specimens for each condition.

The following Table lists the values of the various samples with respect to percentage of cold rolling, the time interval between the cold rolling step ("Time") and the stretching step and the percentage of stretching. As can be seen from the table, the percentage of cold rolling was maintained relatively constant for each sample set, with the time interval between cold rolling and stretching varying between 2 and 48 hours. The stretching varied between 0% for the control sample and up to 3% for the stretched samples. The table also illustrates the average tensile strength (UTS in ksi) and yield strength (TYS in ksi) values, percent elongation and Charpy Impact Energy (CIE in inch pounds per square root inch) values for each sample. Charpy Impact Energy is a measure of the fracture toughness.

| Sample ID | % Cold Roll | Time (Hr) | Stretch (%) | L-T CIE | L UTS | L TYS | L % Elong |
|---|---|---|---|---|---|---|---|
| Control | 10.6 | 0 | 0.0 | 1073 | 72.9 | 63.8 | 14.3 |
| A1 | 11.5 | 2 | 0.5 | 977 | 72.5 | 64.5 | 14.3 |
| A2 | 11.5 | 2 | 1.5 | 864 | 73.7 | 69.6 | 14.6 |
| A3 | 11.5 | 2 | 2.5 | 779 | 74.9 | 72.2 | 12.5 |
| B1 | 11.5 | 8 | 0.5 | 947 | 73.5 | 66.4 | 12.9 |
| B2 | 11.5 | 8 | 1.5 | 874 | 74.6 | 70.6 | 14.3 |
| B3 | 11.5 | 8 | 2.5 | 729 | 76.0 | 72.7 | 13.6 |
| C1 | 11.0 | 24 | 0.5 | 1010 | 72.4 | 64.2 | 14.3 |
| C2 | 11.0 | 24 | 2.0 | 946 | 73.7 | 70.8 | 14.3 |
| C3 | 11.0 | 24 | 3.0 | 905 | 74.3 | 71.4 | 13.6 |
| D1 | 11.0 | 48 | 0.5 | 1046 | 73.2 | 65.6 | 15.0 |
| D2 | 11.0 | 48 | 1.5 | 983 | 73.6 | 69.5 | 14.3 |
| D3 | 11.0 | 48 | 3.0 | 992 | 74.2 | 70.6 | 12.5 |

Figure 2:
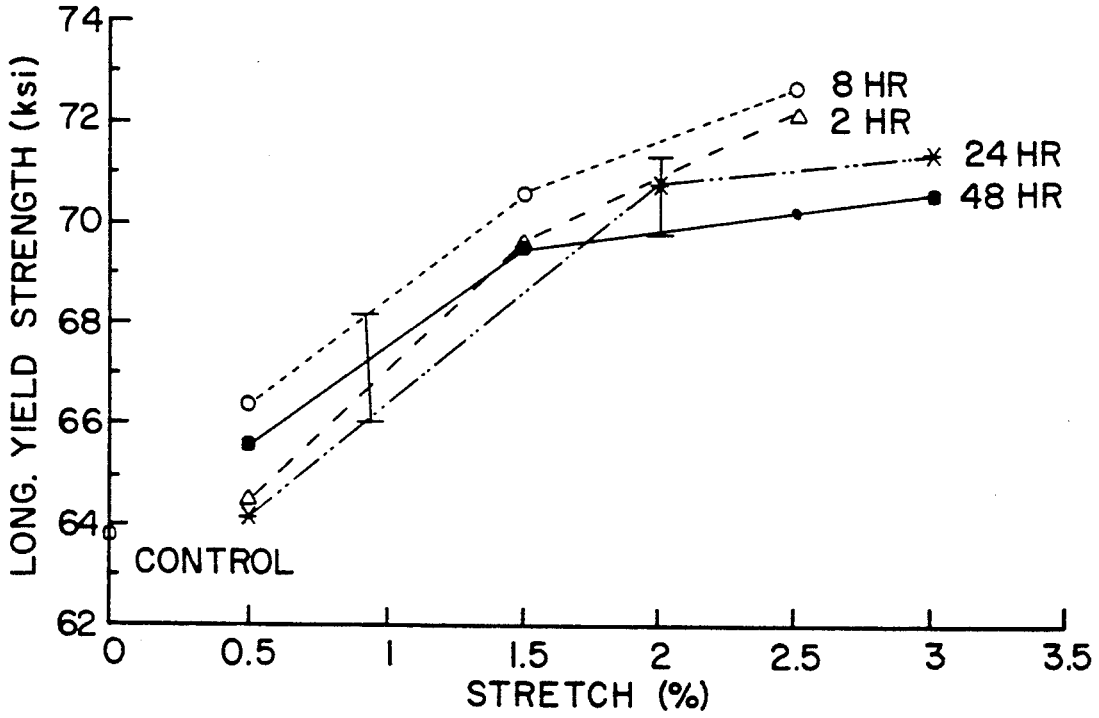
FIG. 2 shows another graph plotting yield strength as a function of stretch percentage for various time intervals following cold rolling.

The influence of final stretch on 2324-T39 plate product tensile and yield strengths is shown in FIGS. 1 and 2, respectively. In the figures, strength is plotted as a function of stretch percentage for various time delays following cold rolling. In each case, strength increases with increasing stretch percentage. However, the effect is largest for the yield strength (approximately +12% yield vs. +4% tensile).

Figure 3:
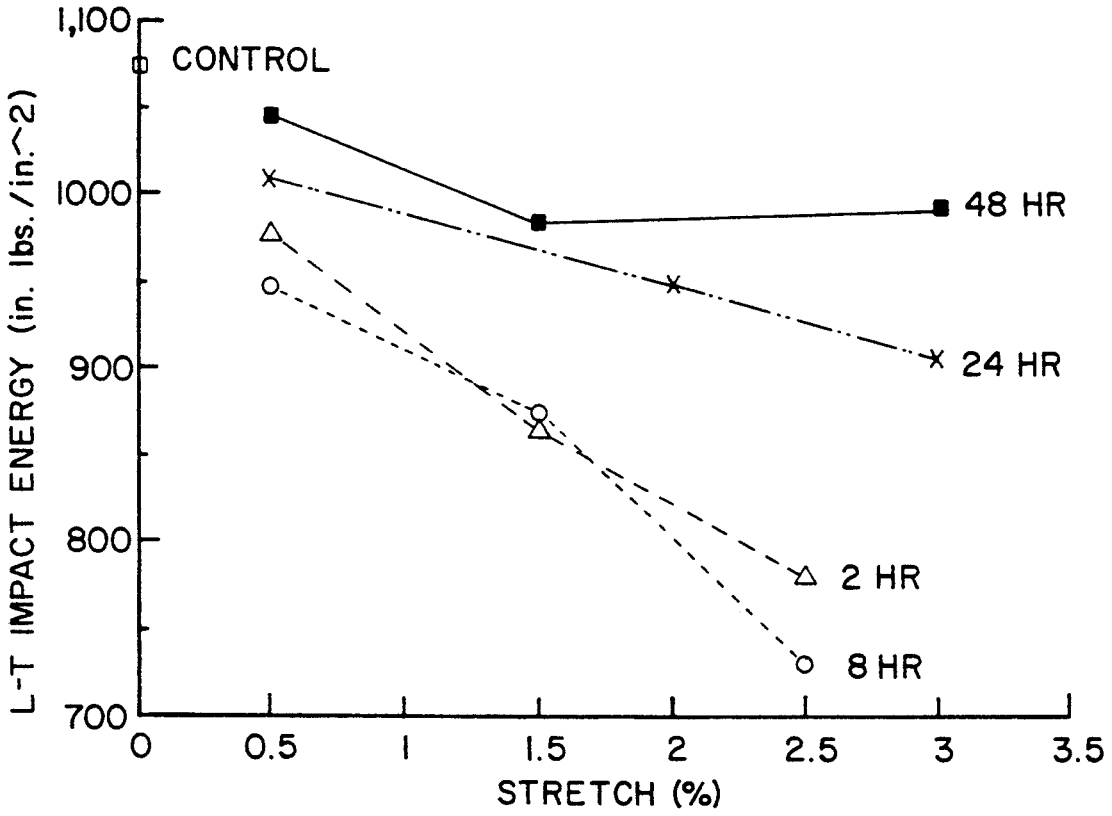
FIG. 3 shows a graph plotting impact energy as a function of stretch percentage for various time intervals following cold rolling.

The effect of the final stretch on fracture toughness as measured by Charpy Impact Energy, for various time delays after cold rolling, is shown in FIG. 3. For each time delay, toughness diminishes with increasing stretch percentage. A tendency towards lower fracture toughness is expected as a consequence of the higher strength accompanying increased cold work. However, the time interval between cold rolling and stretching has a very large effect on the rate of decline in CIE value. In the samples stretched within 8 hours of cold rolling, the CIE value drops approximately 20% over the stretch range of 0.5–2.5%. The 24-hour interval showed only a 10% drop over the stretch range of 0.53–3.0%, while the 48-hour interval showed only a 5% drop.

Figure 4:
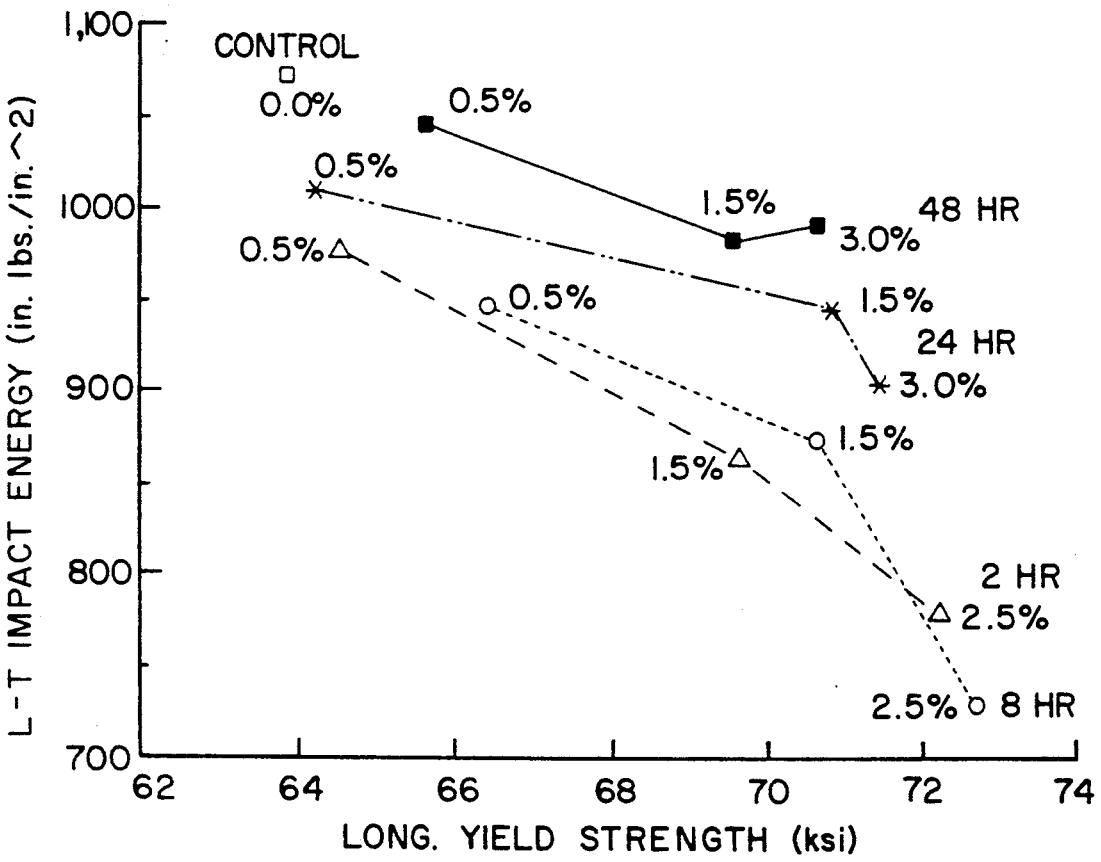
FIG. 4 shows another graph depicting impact energy plotted as a function of yield strength for various time intervals following cold rolling.

The importance of the time period between cold roll and stretch to overall plate properties is illustrated in FIG. 4, where CIE values are plotted as a function of yield strength for various time intervals between cold roll and stretch. In the range of yield strengths above 68 ksi, material held between 24–48 hours after cold rolling can be stretched in the range of 1.5–3.0% without appreciable losses in CIE toughness. Conversely, material held for only 2–8 hours prior to stretching produces CIE values as much as 15–20% lower after stretching only 1.5–2.5%.

Strength in 2324-T39 results from a complex combination of natural aging (i.e., GP zone formation) and cold work. When saturated solid solution materials, such as 2324-T39 plate products, are cold rolled, there is a strong interaction between the excess solute in solid solution and the dislocation distribution introduced by cold working. Once adequate time has passed for the material to reach metastable equilibrium, the excess solute in solid solution is partitioned between GP zones and dislocations.

The incubation period, or hold time, between quenching and cold working determines how the excess solute is partitioned between these defects. For example, the longer the incubation period, the more developed the GP zone distribution becomes before cold working. Therefore, less additional solute is available for partitioning to dislocations. Conversely, the shorter the incubation period, the less developed the GP zone distribution becomes before cold working. Therefore, a large quantity of solute is available for segregation to dislocations.

The increase in strength resulting from stretching following cold rolling can be understood as simply the result of increased total cold work. However, the combination strength/toughness behavior is complicated by solute partitioning. In the case of stretching within a few hours of cold rolling (2–8 hours), the additional dislocations introduced by the stretching operation appear to the solid solution as being similar or identical to those introduced by cold rolling. Therefore, solute partitioning to the stretch added dislocation structures occurs to nearly the same extent as to the cold roll added dislocation structures. The total dislocation structure (cold rolled + stretched) is, thereby, pinned by solute partitioning. In order for plastic deformation to occur, the pinned dislocation structures must be freed or new dislocations must be created.

In the case of stretching after the natural aging process has essentially reached metastable equilibrium there is little remaining solute available for segregation to the stretch added dislocation structure. The time required to reach metastable equilibrium is determined by several factors, such as ambient temperature and the amount of solute super-saturation in the alloy. This time could range between approximately 12–16 hours or longer. Stretching after longer hold times, such as at least 24 hours, ensures that the condition of the alloy approaches metastable equilibrium.

Additionally, the dislocations added by stretching after a minimum intentional time delay are more homogeneously distributed since new dislocation sources are activated by the pinned cold rolled structure. This material would, consequently, have a higher mobile dislocation density since little solute pinning of the stretch added dislocations occurs. Therefore, the higher fracture toughness of the material held for 24–48 hours may be explained in terms of the higher relative mobility and homogeneity of its dislocation distribution. Fracture toughness is favored by a high mobile dislocation density, because the material can more readily respond to applied stresses. The experimental procedures and testing described previously, in which composition, grain structure, natural aging and cold rolling were held constant, demonstrate that the delay in the final stretch affects yield strength, tensile strength and fracture toughness. As can be seen from the table and the figures, longitudinal tensile strength increases modestly, for example, less than 5%, with stretch increasing from 0.5 to 3.0%.

Regarding yield strength, increasing stretch percentages between 0.5 and 3.0% result in significant increases in longitudinal yield strength, e.g., exceeding 10%. Shorter time intervals between cold rolling and stretching, e.g. 2–8 hours, appear to produce larger strength increases than longer time intervals, e.g. 24–28 hours.

With increasing stretch percentages between 0.5 and 3.0%, fracture toughness as measured by Charpy Impact Energy values diminishes. The negative rate of change in fracture toughness values with increasing strength, however, is unexpectedly and strongly diminished by the increased time interval between cold rolling and stretching. One of the significant benefits provided by the present invention is the ability to increase the amount of stretch without an unacceptable decrease in fracture toughness. As a result, the plate product provided by the invention is easier to handle in subsequent machining and fabrication operations than the plate products provided by the previously known process.

As evidenced by the experimental testing and various processing sequences, by providing a time delay of between 24 to 48 hours or longer between cold rolling and stretching, fracture toughness is decreased only 5–10% for a 3% stretch. In contrast, after a time delay of only 2–8 hours between cold rolling and stretching, fracture toughness values are decreased by approximately 20% when stretching is performed at an even lower stretch of 2.5%.

By providing an intentional time delay between cold rolling and stretching, an improved plate product is provided which does not show a large negative change in fracture behavior as compared to a plate product subjected to stretching within a short period following cold rolling, e.g. 2–8 hours. Moreover, increases in strength were found to be only slightly influenced by the times between cold rolling and stretching. As such, an aluminum alloy plate product subjected to the processing of the present invention is provided with improved fracture toughness while still retaining acceptable levels of strength.

Although the experimental procedures discussed above were performed on a particular 2324-T39 aluminum plate product, the invention method of delaying the final stretch following a cold rolling operation may be utilized with any cold worked and naturally aged 2000 series aluminum alloy. It is believed that the same microstructural behavior involving mobile dislocation density and unavailability of remaining solute will provide improved fracture toughness in similar alloy compositions. For instance, the process is expected to be useful with alloys similar to 2324 in which the dispersoid forming addition, which is Mn in 2324, is either modified or replaced other dispersoid forming elements, singly or in combination, such as Zr, V, or rare earth elements. The invention also is potentially useful with other aluminum alloy systems that exhibit improvements with natural aging, such as Al-Mg and Al-Zn.

As such, an invention has been made and disclosed in terms of preferred embodiments thereof which fulfill each and every one of the objects of the present invention as set forth hereinabove. The invention provides a new and improved method of making aluminum alloy plate products having improved fracture toughness.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A method of making a 2000 series aluminum alloy plate product having improved combinations of strength and fracture toughness comprising the steps of:

(a) forming an aluminum alloy plate;

(b) solution heat treating said formed plate;

(c) quenching said solution heat treated plate;

(d) aging said quenched plate;

(e) cold rolling said aged plate; and (f) stretching said plate product to form said aluminum alloy plate product having improved combinations of strength and fracture toughness, said stretching step further comprising the step of providing an intentional time delay between said cold rolling step and said stretching step of at least about 12 hours such that said aluminum alloy plate exhibits improved combinations of strength and fracture toughness.

2. The method of claim 1 wherein said aluminum alloy is a 2324 aluminum alloy.

3. The method of claim 1 wherein said stretching step further comprises stretching said aluminum alloy plate between 1.0 and 3.0%.

4. The method of claim 3 wherein said time delay is sufficient for the cold rolled plate to essentially reach metastable equilibrium.

5. The method of claim 1 wherein said time delay is sufficient for the cold rolled plate to essentially reach metastable equilibrium.

6. The method of claim 4 wherein said time delay ranges between 24 and 48 hours.

7. The method of claim 5 wherein said time delay ranges between 24 and 48 hours.

8. The method of claim 4 wherein said aluminum alloy is a 2324 aluminum alloy.

9. The method of claim 5 wherein said aluminum alloy is a 2324 aluminum alloy.

10. The product according to the method of claim 5.

11. The product according to the method of claim 6.

12. The method of claim 1 wherein said time delay is at least 14 hours.

13. The method of claim 1 wherein said time delay is at least 18 hours.

14. The product according to the method of claim 13.

* * * * *